US007635231B2

(12) United States Patent
Terry et al.

(10) Patent No.: US 7,635,231 B2
(45) Date of Patent: Dec. 22, 2009

(54) WRITING ASSISTANCE DEVICE

(76) Inventors: Caitlin Elizabeth Terry, 22 Columbia Ave., Vineland, NJ (US) 08360; Ronald M. Mills, 82 Andover Pl., Robbinsville, NJ (US) 08691

( * ) Notice: Subject to any disclaimer, the term of this patent is extended or adjusted under 35 U.S.C. 154(b) by 639 days.

(21) Appl. No.: 11/374,632

(22) Filed: Mar. 13, 2006

(65) Prior Publication Data

US 2006/0204313 A1 Sep. 14, 2006

Related U.S. Application Data

(60) Provisional application No. 60/660,569, filed on Mar. 11, 2005.

(51) Int. Cl.
*A46B 11/00* (2006.01)
*A46B 17/02* (2006.01)

(52) U.S. Cl. ..... 401/48; 401/6; 401/88; 401/131; 15/443

(58) Field of Classification Search ..... 401/6, 401/48, 88, 92, 131, 28; 33/27.03, 27.02, 33/18.1, 18.2; 211/69.5, 69.1; 434/162, 434/166, 260, 261; 15/443, 445, 427, 434; 16/421, 430

See application file for complete search history.

(56) References Cited

U.S. PATENT DOCUMENTS

| | | | | | |
|---|---|---|---|---|---|
| 724,687 | A * | 4/1903 | Floren | ..... | 401/48 |
| 1,848,605 | A * | 3/1932 | Conway | ..... | 401/48 |
| 2,362,992 | A * | 11/1944 | Dentzler, Jr. | ..... | 401/48 |
| 2,497,418 | A * | 2/1950 | Schroeder, Jr. | ..... | 401/48 |
| 3,853,411 | A * | 12/1974 | Ciraolo | ..... | 401/48 |
| 4,095,906 | A * | 6/1978 | Sackett | ..... | 401/48 |
| 4,511,272 | A * | 4/1985 | Brown et al. | ..... | 401/48 |
| 4,917,517 | A * | 4/1990 | Ertz | ..... | 401/48 |
| 4,957,442 | A * | 9/1990 | Prater | ..... | 401/48 |
| 5,383,737 | A * | 1/1995 | Urion | ..... | 401/48 |
| 5,391,010 | A | 2/1995 | Gorbunov | | |
| 5,470,162 | A | 11/1995 | Rubin | | |
| 5,785,443 | A | 7/1998 | Rubin | | |
| 6,062,754 | A * | 5/2000 | Holdren | ..... | 401/48 |
| 7,484,903 | B2 * | 2/2009 | Komorowski | ..... | 401/48 |

* cited by examiner

*Primary Examiner*—David J Walczak
*Assistant Examiner*—Keegan Gumbs
(74) *Attorney, Agent, or Firm*—John F. Letchford; Archer & Greiner, P.C.

(57) ABSTRACT

A writing assistance device including a hand support and at least one writing instrument holder. The hand support includes a base member adapted for contacting a surface upon which a user intends to write, and an upper member movably connected to the base member. The upper member is preferably dimensioned to accommodate a substantial portion of a user's hand and the writing assistance device is designed such that manipulation of the device is accomplished, in part, by downward force generated by the weight of a user's hand and forearm on the hand support rather than gripping of the hand support. The device includes resilient biasing structure to achieve effective separation of the upper member from the base member in order to raise a writing instrument when a user lifts his or her hand (or causes his or her hand to be lifted) from the upper member.

10 Claims, 8 Drawing Sheets

WRITING ASSISTANCE DEVICE

CROSS REFERENCE TO RELATED APPLICATION

The present application claims the benefit of U.S. Provisional Patent Application No. 60/660,569, filed Mar. 11, 2005, which is incorporated herein by reference in its entirety.

FIELD OF THE INVENTION

The present invention relates in general to physically handicapped persons' assistance devices and in particular to writing instrument (defined infra) assistance devices.

BACKGROUND OF THE INVENTION

Many persons have hereditary, congenital or acquired handicaps that inhibit their ability to effectively hold and manipulate writing instruments of any and all types, which include, by way of example but not limited to the following, pens, pencils, markers, stylus', and the like (for each and every type of use, including each and every type of traditional use and each and every type of digital, electronic and computer use and the like) (hereinafter collectively referred to as "writing instruments"). Examples of hereditary and congenital handicaps include neuromuscular disorders that manifest themselves at various stages of life, syndactyly ("webbing" of the fingers) or other deformities. Acquired handicaps may arise from a wide array of factors such as repetitive injury (e.g., carpal tunnel syndrome), infection, poisoning, trauma, amputation, and drug and alcohol abuse, among others. In addition, arthritis and rheumatism are painful conditions afflicting a substantial portion of the population that may inhibit comfortable and proper use of writing instruments.

A number of solutions have been proposed for this problem, an assortment of which are offered for sale on the Internet by The Society for the Physically Disabled based in Singapore. Examples include enlarged pens and devices that are either grasped by and/or fastened to a user's hand (or forearm). A disadvantage of such devices is that they require a certain minimum level of user dexterity and strength merely to grasp the device or fasten it to the user's body. Likewise, the user is disadvantaged by the fact that such devices may not provide the user with the necessary support base (for operation of a writing instrument) and/or may not provide the user with the necessary latitude and flexibility when using such writing instrument. Many people may not be able to perform these seemingly simple tasks. Other examples of such devices are disclosed in U.S. Pat. Nos. 5,391,010; 5,470,162 and 5,785,443.

U.S. Pat. No. 4,917,517 describes an ambidextrous writing assistance device including a hand support formed in the shape of the body of a bird and a set screw clamp for securing a writing instrument to the hand support. When a user wishes to raise the tip of the writing instrument, such as at the end of a line or word, he or she must flex the wrist to apply a downward rotational force to the rear or "tail" portion of the hand support. This may not be reasonably possible for users who are incapable of performing such motion or find it painful, impractical or unreasonable to do so. The hand support is also configured such that it is grippingly embraced within a user's palm and fingers. Such a design is essentially useless to persons with disabilities or deformations that might prevent them from reasonably and effectively gripping the hand support. In addition, the set screw clamping mechanism may be unreasonably difficult for some users to effectively tighten and loosen, possibly even requiring the assistance of another person to insert or remove a writing instrument from the device.

An advantage exists for a comfortable and easy to use writing instrument assistance device (hereinafter, a "writing device") that does not require attachment to a user's body; that does not require the unreasonable flexing of the wrist or other like hand, wrist and/or arm movements; and, that does not requires the user to engage in unreasonable gripping motions to effectively operate the writing assistance device.

A further advantage exists for a writing assistance device that permits easy insertion and withdrawal of a writing instrument.

SUMMARY OF THE INVENTION

The present invention provides a writing assistance device including hand support means, at least one writing instrument holder, and writing instrument raising means. The hand support means comprise a substantially planar base member adapted for contacting a surface upon which a user intends to write, and an upper member movably connected to the base member and configured to substantially conform to the inner surfaces of a user's hand. The upper member is preferably dimensioned and contoured to accommodate a user's hand such that manipulation of the device is accomplished, in part, by downward force generated by the weight of a user's hand and forearm on the hand support rather than gripping of the hand support means by the user. Indeed, the user need not grip the hand support means at all in order to manipulate the device. Resting of the user's hand on the upper portion and moving his or her arm (which may be accomplished by the user merely moving or shifting his or her torso and the like)in a desired direction is all that is required.

According to presently contemplated embodiments, the upper member is movable, preferably pivotable, with respect to the base member in order permit raising of a writing instrument when a user lifts his or hand from the upper member. To achieve effective separation of the upper member from the base member, if the base and upper members are discrete components, the writing instrument raising means preferably comprise resilient biasing means such as one or more springs or elastomeric means. If the base and upper members are constructed as an integral unit the resilient biasing means may be a living hinge formed at the contiguous juncture of the base and upper members. Thus, when it is desired to raise the tip of the writing instrument, the user simply lifts (or causes to be lifted) his or her hand from the device and the writing instrument raising means raises the upper member and the writing instrument carried thereby.

According to a first embodiment, the writing instrument raising means is a spring situated near a forward end of the device and disposed between the base and upper members. In the inoperative state of the device, the spring biases the upper member upwardly about a hinged connection near the rear of the device. When a user places his or hand on the device, the spring is depressed by the weight of the user's hand and forearm, thereby rotating the forward end of the upper member downwardly until the tip of a writing instrument carried by the device contacts the surface upon which the user desires to write. According to this embodiment, the device further includes a writing instrument holder that is easily detachable from the device by a depression of a button.

According to another embodiment, the writing instrument holder comprises a one-way gripping arrangement whereby a writing instrument is withdrawn from the device in the direction of its insertion into the device. In utilizing such a gripping arrangement, a writing instrument is initially inserted into the upper member of the device to an extent sufficient whereby its tip contacts a writing surface when the user rests his or her hand on the upper member. When it is desired to remove the writing instrument from the device, the user simply continues to push the writing instrument through the upper member. Such an arrangement is beneficial because it eliminates physical acts requiring considerable gripping strength, twisting, turning and the like which may be difficult and unreasonable for some users.

Other details, objects and advantages of the present invention will become apparent as the following description of the presently preferred embodiments and presently preferred methods of practicing the invention proceeds.

BRIEF DESCRIPTION OF THE DRAWINGS

The invention will become more readily apparent from the following description of preferred embodiments thereof shown, by way of example only, in the accompanying drawings wherein.

DETAILED DESCRIPTION OF THE INVENTION

Figure 1:
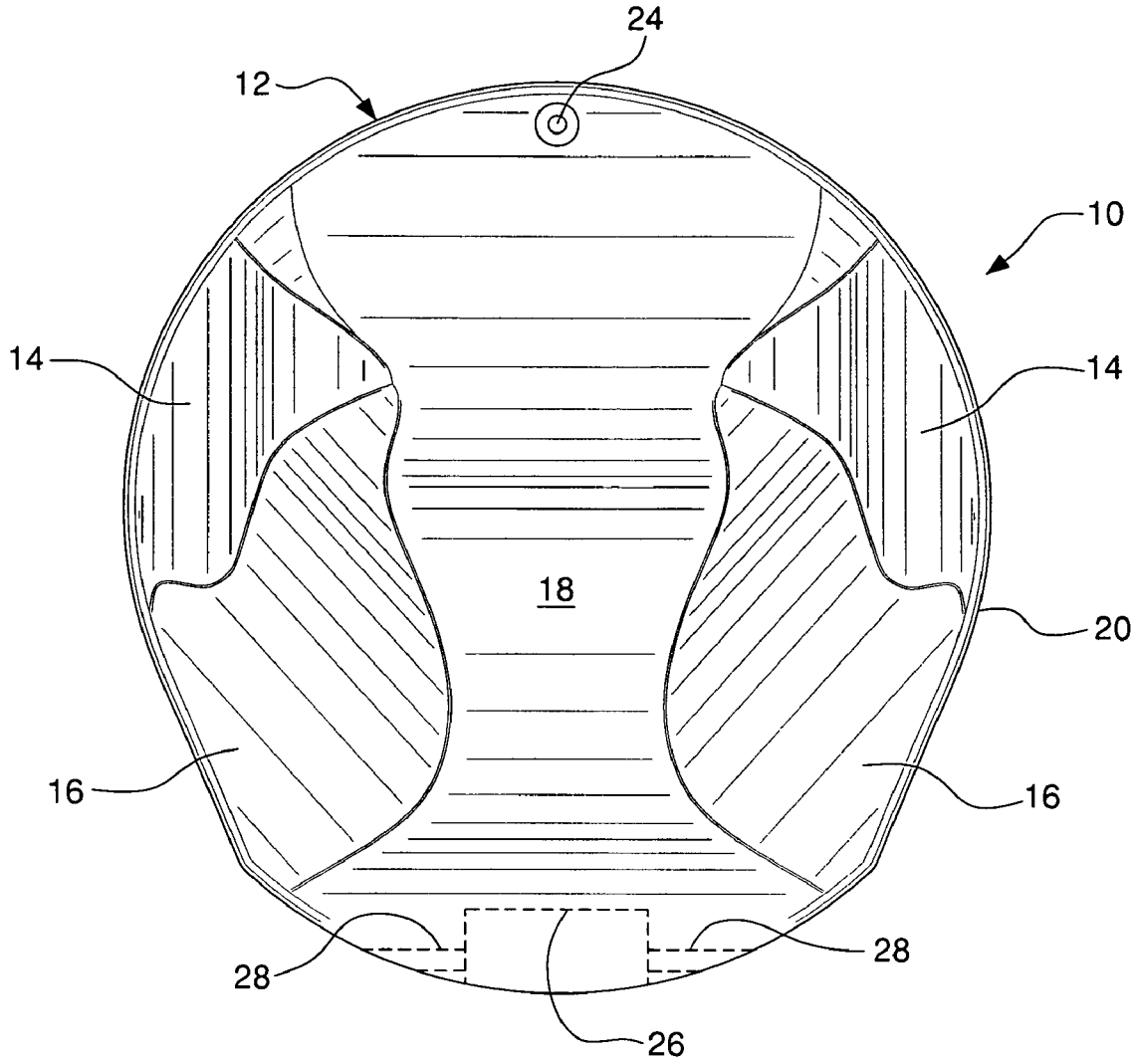
FIG. 1 is a top plan view of an upper member of a writing instrument assistance device according to a first embodiment of the present invention.

Referring to the drawings wherein like or similar references indicate like or similar elements throughout the several views, there is shown in FIGS. 1-5 are various views of an upper member 12 of a writing assistance device, identified generally by reference numeral 10, constructed in accordance with a first embodiment of the present invention. Upper member 12 is preferably ergonomically shaped to comfortably support a user's hand. And, although it may manufactured exclusively for left or right handed persons, it is preferably ambidextrous in design in order to accommodate both left and right handed users. The upper member 12 is generally convex in shape and contoured to substantially mate with the various portions of the undersurface of the human hand, and it may be sized to fit users ranging from small children to large adults. In particular, upper member 12 desirably includes symmetrically arranged first side regions 14 adapted for receiving either one of a user's thumbs. Regions 14 transition rearwardly into second side regions 16 adapted for receiving the area of a user's palm closest to the thumb. Regions 14 and 16 in turn merge into a generally convex central region which is adapted to receive the remainder of the user's palm and fingers. A substantially vertical wall 20 defines the periphery of the upper member. The bottom of wall 22 is preferably planar so as to closely abut the upper surface of a base member, described below. Upper member 12 may be fabricated from any suitable material such as wood, metal plastic, or the like. However, for ease and economy of manufacture, the upper member is preferably formed from any conventional durable thermoplastic material.

Figure 2:
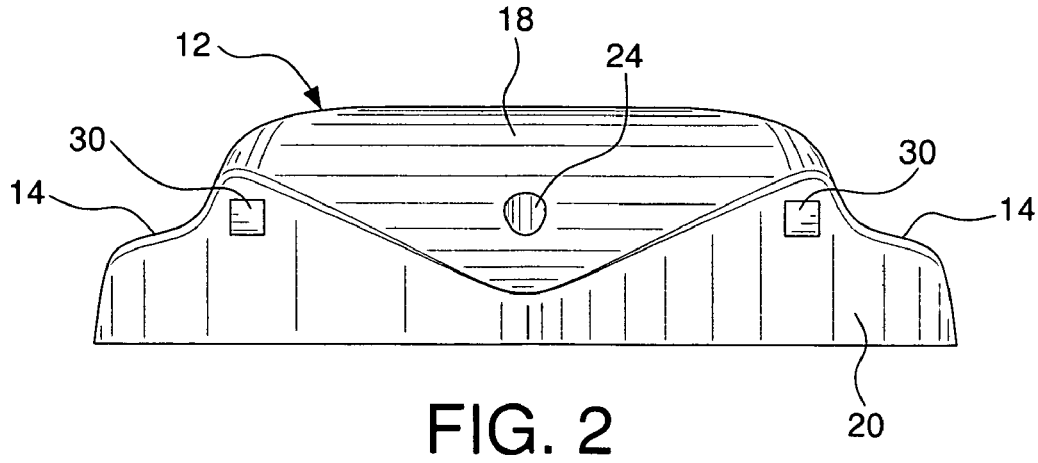
FIG. 2 is a front elevation view of the upper member of FIG. 1.
Figure 3:
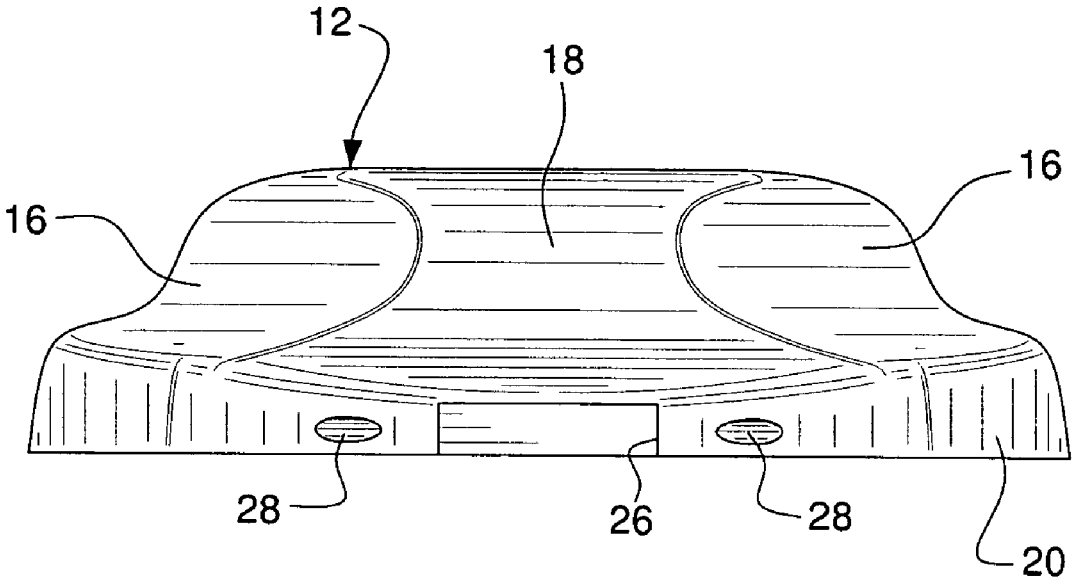
FIG. 3 is a rear elevation view of the upper member of FIG. 1.
Figure 4:
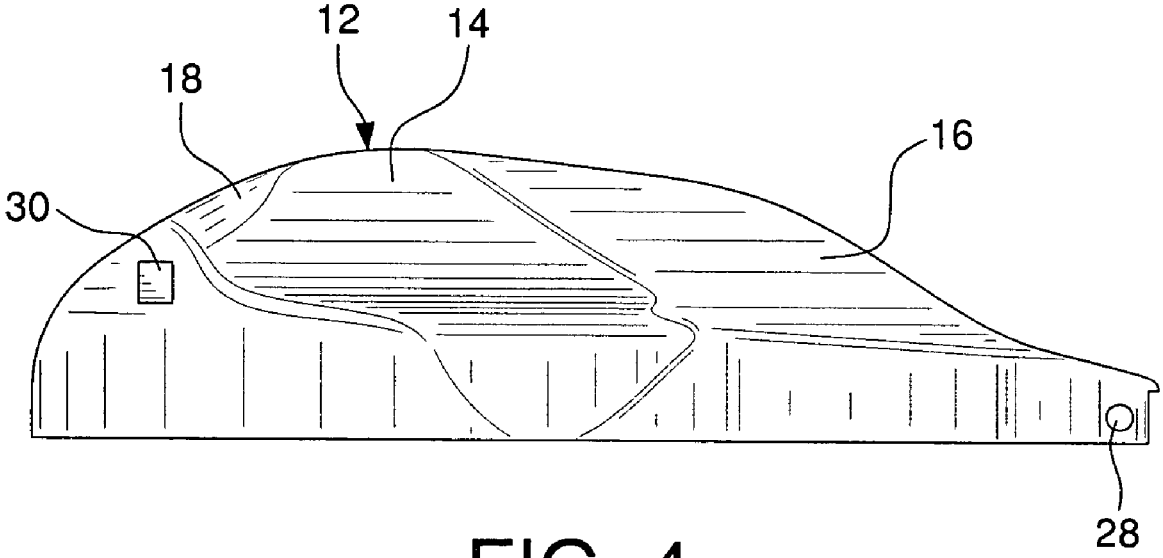
FIG. 4 is a left side elevation view of the upper member of FIG. 1.

At its forward end (the upper end of FIG. 1) central region 18 includes an opening 24 for receiving a screw or similar fastener whose function is described in connection with FIG. 12. At its rearward end the central region is provided with a recess or notch 26 and a pair of coaxial circular passageways 28 which, along with cooperating structure provided on a base member (described below), establish a hinged connection between the upper and base members. FIGS. 2 and 4 reveal that the forward end of wall 20 is formed with external opening(s) 30 of at least one or, preferably, two channels adapted to receive a writing instrument holder, which channels and holder are discussed below.

Figure 5:
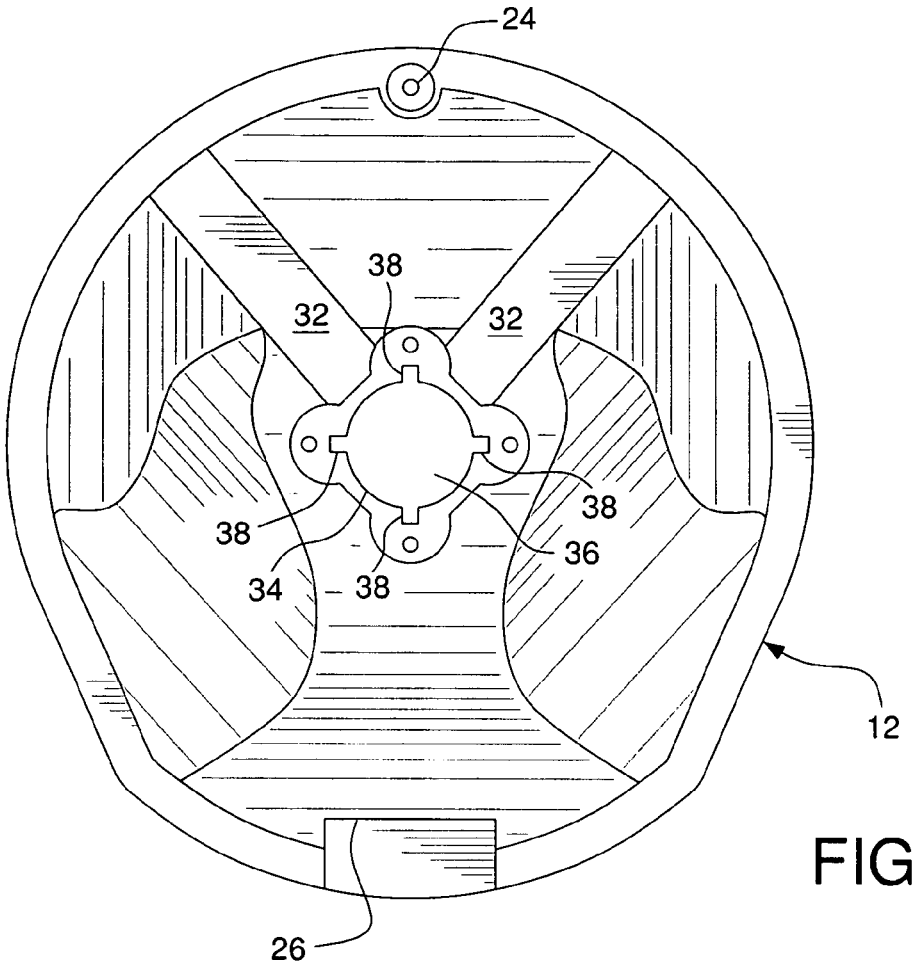
FIG. 5 is a bottom plan view of the upper member of FIG. 1.

FIG. 5 illustrates the operative internal structures of the upper member 12. As seen in that figure, the upper member is preferably generally hollow with the exception of one or, more preferably, two writing instrument holder channels 32 whose external openings 30 are shown in FIGS. 2 and 4 as noted above. Channel(s) 32 extend radially inwardly toward and communicate with a generally centrally located hub 34. The hub includes a socket 36. Preferably, at least one slot 38 radially projects from socket 36 for enhancing guidance of the motion of a later-described writing instrument capture and release button with respect to socket 36.

Figure 6:
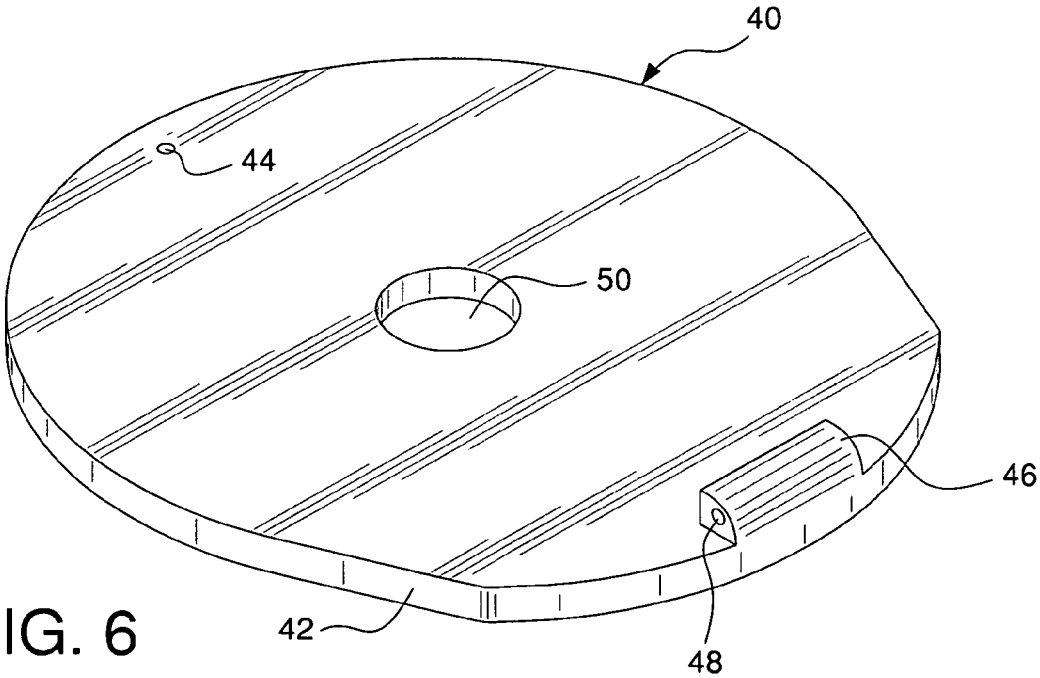
FIG. 6 is a perspective view of a base member according to the first embodiment of the writing instrument assistance device of the present invention.

Referring to FIG. 6, there is shown a base member 40 adapted for connection with upper member 12. Base member 40 is also preferably made from any suitable material, although thermoplastics are preferred. The base member includes a peripheral wall 42 preferably corresponding in size and shape to that of wall 20 of upper member 12. At its forward end the base member includes a threaded hole 44. Hole 44 cooperates with hole 24 of upper member 12 and a spring 86 (FIG. 12) as described hereinafter. A hinge component 46 projects upwardly from the rear edge of the base member. Passing longitudinally through the hinge component 46 is a passageway 48 which is adapted for alignment with passageways 28 of upper member 12. Together passageways 28 and 48 and an unillustrated hinge pin cooperate to form a hinged connection between the upper and base members 12 and 40. Base member 40 also includes a generally centrally located opening 50. The base and upper members are arranged such that opening 50 aligns with socket 36 of hub 34 of the upper member such that they cooperate to receive a writing instrument capture and release button described in connection with FIG. 8.

Figure 7:
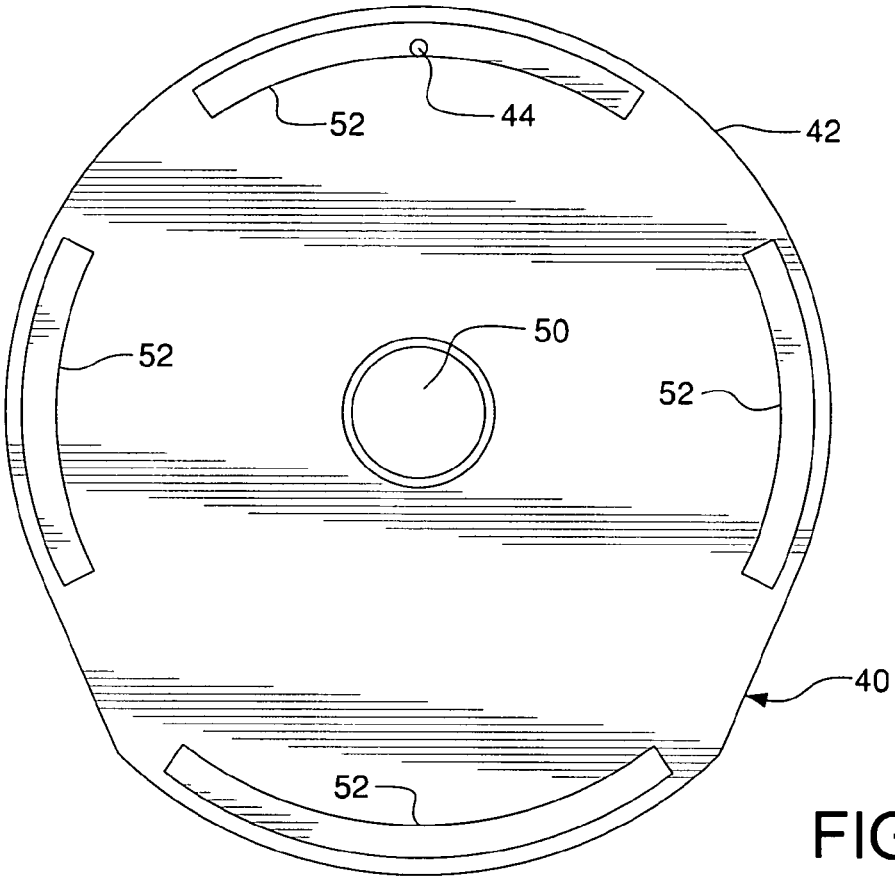
FIG. 7 is a bottom plan view of a base member of FIG. 6.

FIG. 7 shows the bottom surface of base member 40. Optionally, and preferably, the bottom surface of the base member is provided with one or more raised friction-reducing skid pads 52. The skid pads serve to reduce the contact area of the bottom surface of the base member and thereby the frictional resistance experienced by a user when moving the writing device across a writing surface. Skid pads 50 may be of the same or different material as the remainder of base member 40. They may formed integrally with the base member or attached thereto after its formation by suitable adhesives, thermal bonding, mechanical fasteners, or any combination thereof.

Figure 8:
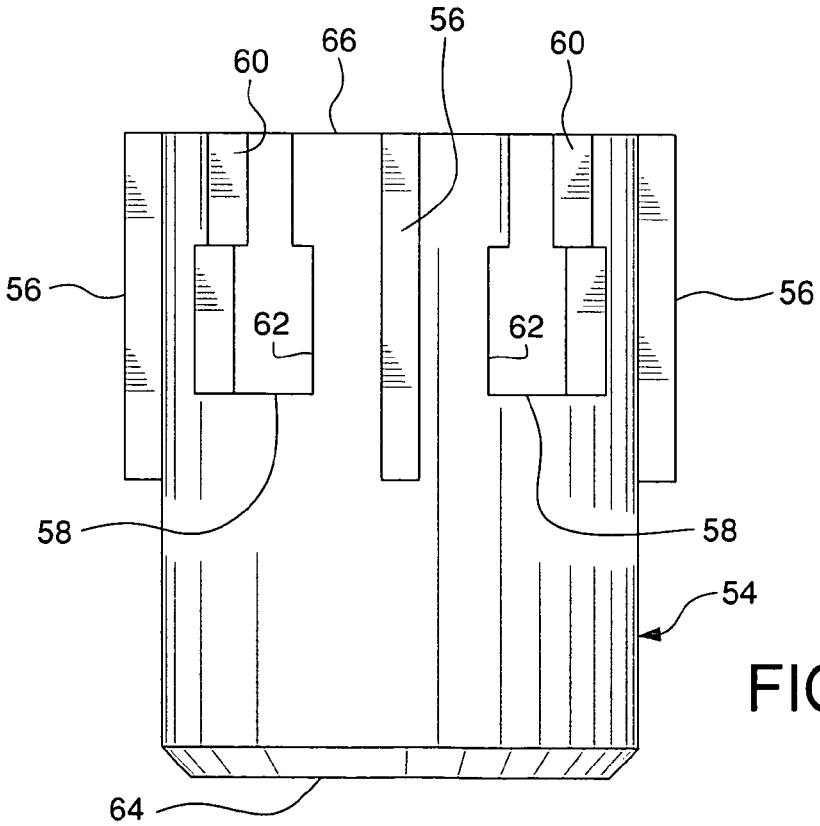
FIG. 8 is a front elevation view of a writing instrument holder capture and release button according to a first embodiment of the present invention.

FIG. 8 depicts a writing instrument holder capture and release button 54 according to the present invention. The outer wall of button 54 is provided with at last one radially projecting spline 56 corresponding in arrangement and number to the slots 38 of socket 36 of upper member 12. The mating relationship of splines 56 and slots 38 avoids undesirable rotation between the button 54 and channels 32 that might hinder proper capture and release of the writing instrument holder described in connection with FIG. 9.

The outer wall of button 54 is also provided with at least one, preferably two, writing instrument holder capture and release slots 58. Each slot 58 is comprised of a narrow upper slot portion 60 and a wide lower slot portion 62. In addition, button 54 has an actuator end 64 and a spring receiving end 66, the functions of which will be understood from the description of FIG. 11.

Figure 9:
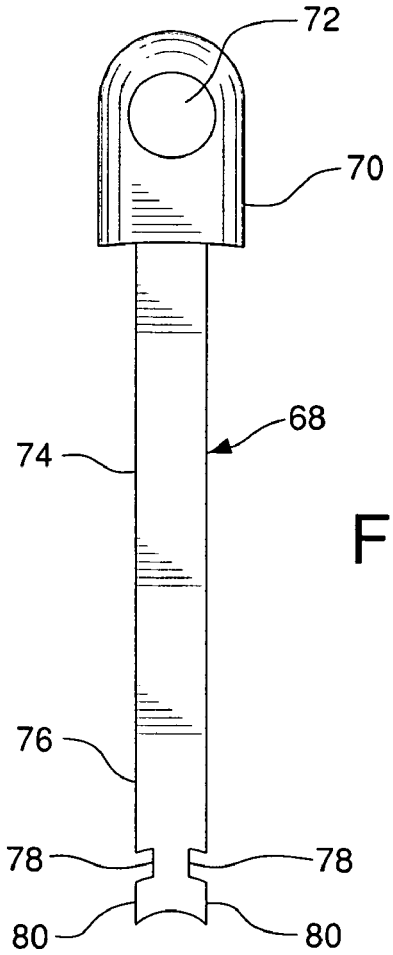
FIG. 9 is a top plan view of a writing instrument holder according to the first embodiment of the writing instrument assistance device of the present invention.

FIG. 9 illustrates a writing instrument holder 68 according to the invention. Holder 68 includes an enlarged first end 70 having an aperture 72 for receiving an unillustrated writing instrument. Optionally, the inner surface of aperture 72 may be provided with a friction-enhancing material such a rubber, a resilient foam, an elastomer, or the like, to increase the gripping force exerted by the aperture to the writing instrument. Additionally, the writing assistance device of the present invention may use a plurality of holders 68 having differently sized apertures 70 to accommodate the various diameters of conventional writing instruments. Holder 68 also includes an intermediate region 74 and a second end 76. The lateral edges of second end 76 are preferably provided with a pair of notches 78 and pair of flanges 80. The width of second end 76 at notches 78 is narrower than both the upper and lower slot portions 60 and 62 of the writing instrument holder capture and release slot 58 of writing instrument release button 54. In contrast, the width of second end 76 at flanges 80 is wider than upper slot portion 60 and narrower than lower slot portion 62. As a result, the writing instrument holder 68 may be selectively captured and released by button 54 in the manner described in connection with FIG. 11.

Figure 10:
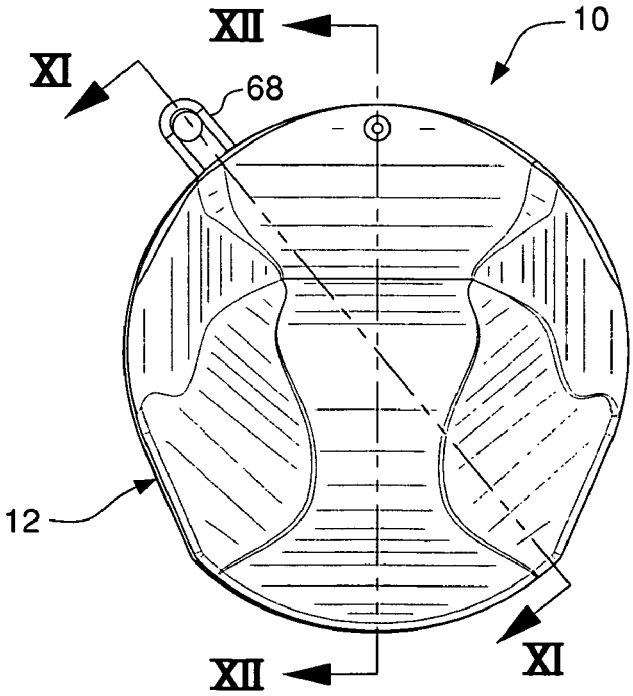
FIG. 10 is a top plan view of the writing instrument assistance device of the present invention in assembled condition.

FIG. 10 is a plan view of device 10 as it would appear when writing instrument holder 68 is captured in upper member 12 for use by a right handed user. If device 10 is ambidextrous in design, the holder 68 may be similarly captured in the corresponding channel for a left handed user.

Figure 11:
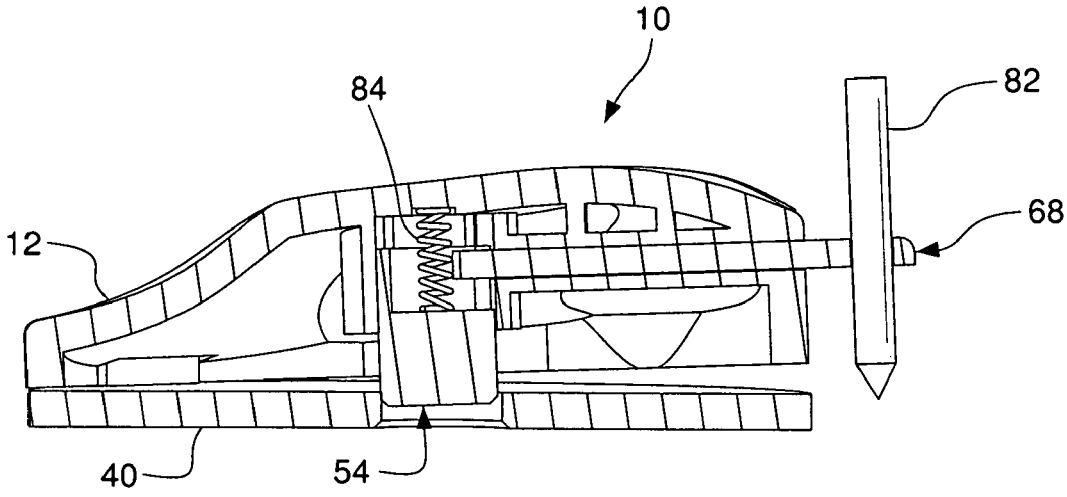
FIG. 11 is an elevational cross-section view taken along line XI-XI of FIG. 10.

FIG. 11 illustrates the interaction of the components that permit capture and release of the writing instrument holder 68 (shown holding a writing instrument 82). A biasing means 84 such as a compression spring or the like is disposed in the interior of device 10 in abutting contact with an inner surface of upper member 12 and the spring receiving end 66 of writing instrument holder capture and release button 54. FIG. 11 shows spring 84 in its uncompressed state. In this position (while referring also to FIGS. 8 and 9) spring 84 presses button 54 downwardly with respect to the hub socket 36 such that the notched area 78 of writing instrument holder 68 is captured within the upper slot portion 62 of a writing instrument holder capture and release slot 58 by virtue of the flanged area 80 of the holder being wider than the upper slot portion 62. When it is desired to release holder 68, the user presses button 54 upwardly until the notched area of the holder passes beneath upper slot portion 62 and into lower slot portion 64 whereby the holder may be withdrawn. To insert a new holder 68, button 54 is again depressed a sufficient distance such that the flanged area 80 thereof may be inserted fully into the lower slot portion 62. The user then releases button 54 and spring 84 pushes the button downwardly to interlock holder 68 with upper portion 12. It will be understood that spring 84 should be selected to effectively perform its intended biasing function yet require little user effort to displace button 54.

Figure 12:
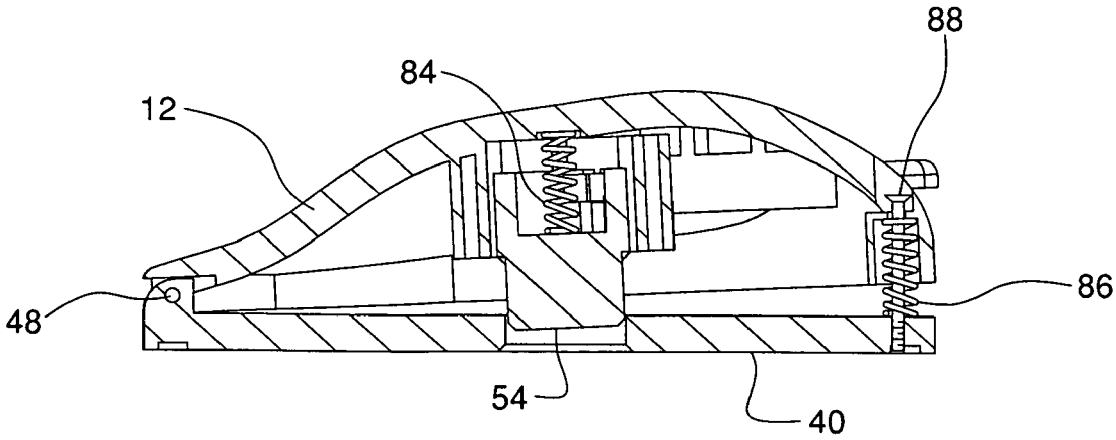
FIG. 12 is an elevational cross-section view taken along line XII-XII of FIG. 9.

FIG. 12 illustrates writing assistance device in its inoperative position. To achieve this state, a biasing means 86 such as a compression spring or the like of sufficient length to separate the forward ends of members 12 and 40 in its uncompressed state is disposed between those members. More particularly, spring 86 is disposed in the interior of device 10 in abutting contact with an inner surface of upper member 12 and the upper surface of base member 40 in alignment with hole 24 (FIGS. 1, 2 and 4) and threaded hole 44 (FIGS. 6 and 7). A screw 88 is passed through hole 24, spring 86 and threaded into threaded hole 44. The force of spring 86 should be selected such that it effectively separates members 12 and 40 yet readily compresses under the weight of a user's hand and forearm so as to bring the tip of the writing instrument into contact with the writing surface. Fine tuning of compressive force of spring 88 may be achieved by selectively threading screw to a desired depth into threaded hole 44.

It will be understood that, as an alternative to compression spring 86, a torsion spring may be arranged coaxially with the hinged connection between upper and base members 12 and 40 to achieve the desired upward biasing of the upper member in relation to the base member.

Figure 13:
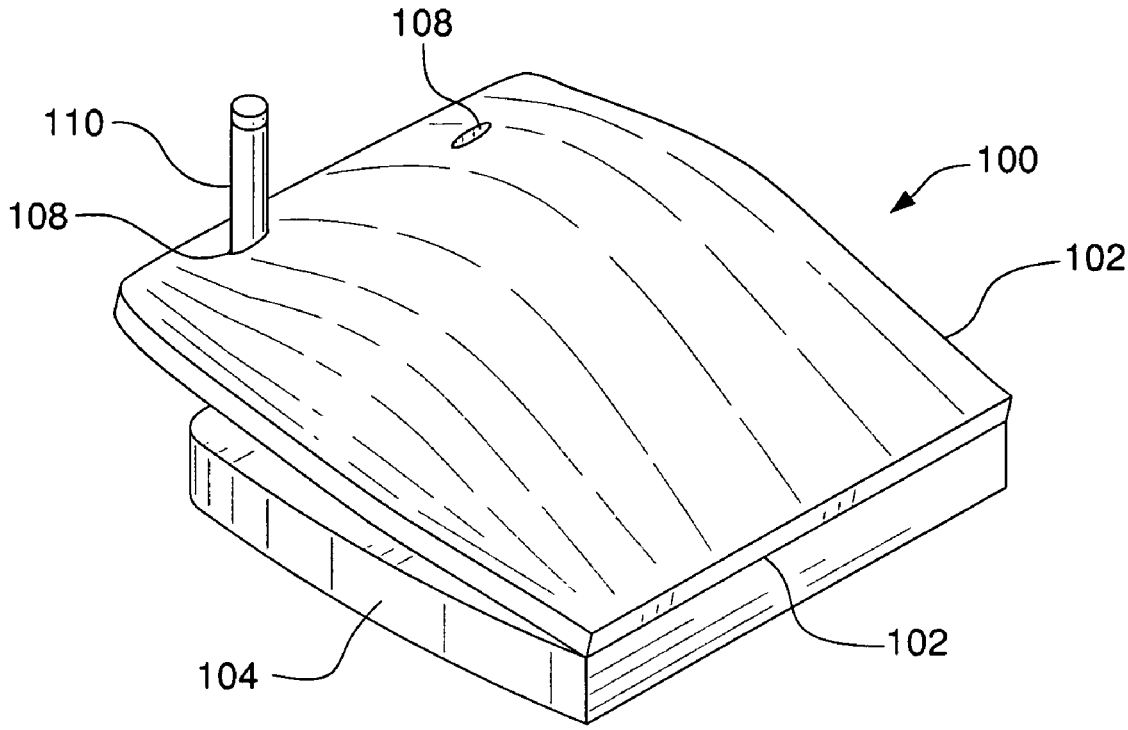
FIG. 13 is a perspective view of a further embodiment of a writing instrument assistance device according to the present invention.
Figure 14:
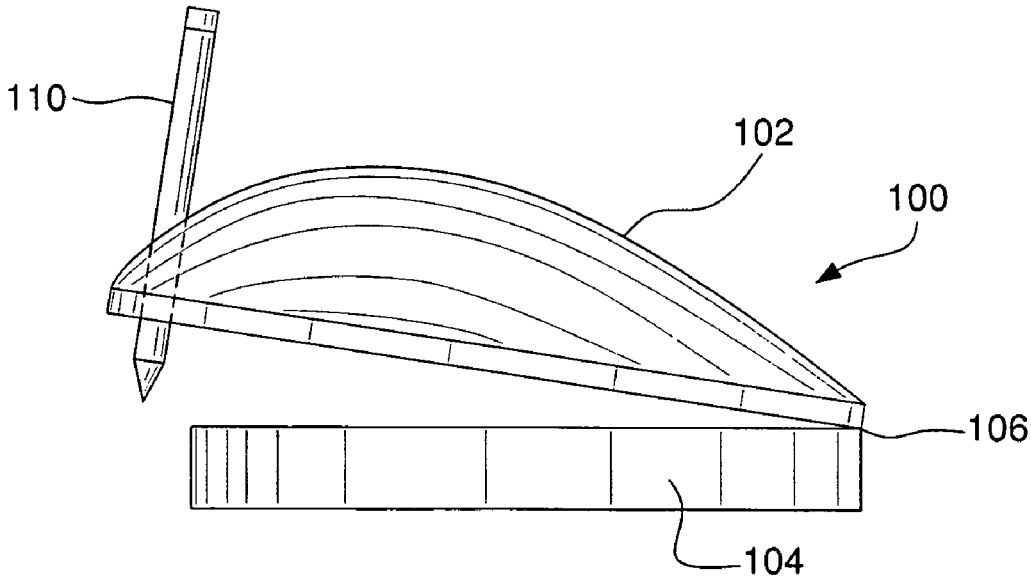
FIG. 14 is a left side elevation view of the writing instrument assistance device of FIG. 13 in an inoperative state.
Figure 15:
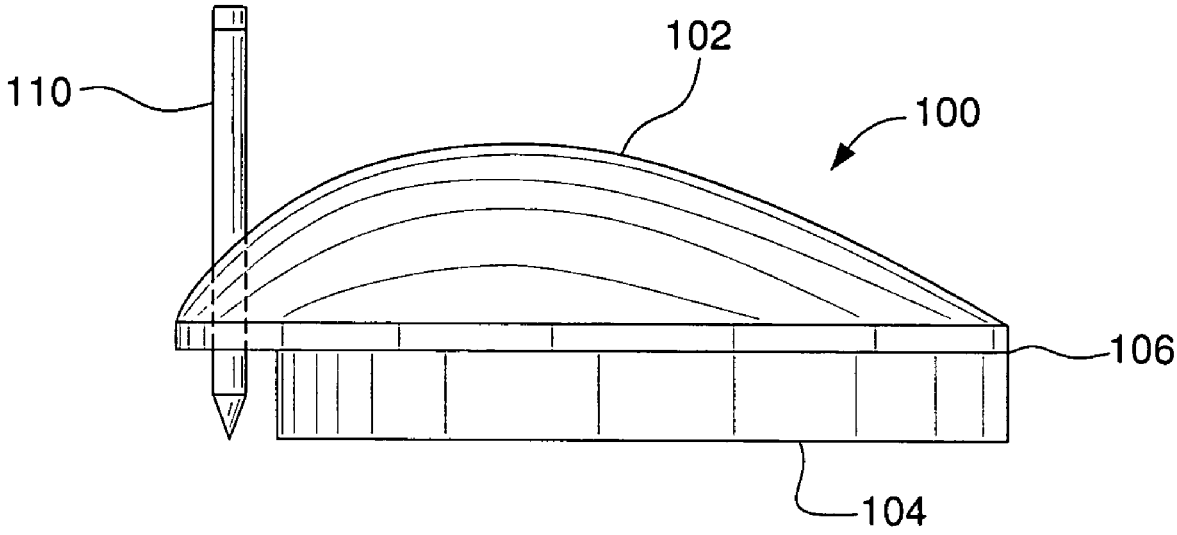
FIG. 15 is a left side elevation view of the writing instrument assistance device of FIG. 13 in an operative state.

FIGS. 13-15 illustrate a writing assistance device 110 according to a further embodiment of the invention. Device 10 may be provided with the surface contours and skid pads described above with regard to device 10. Device 110 comprises an upper portion 102 hingedly connected to a base portion 104. The upper portion includes at least one, preferably two, apertures 108 for releasably holding a writing instrument 110. Unlike device 10, device 110 is formed as a one-piece, unitary object. And, rather than a multi-piece hinge, the upper and base members are joined to one another by an integral contiguous region of reduced thickness material known in the art as a living hinge 106. Any resilient foamed and semi-rigid unfoamed plastic or elastomeric material capable of producing a durable living hinge of low spring force may be used to fabricate device 110. In addition, apertures 108 should be such that they enable a writing instrument to be easily inserted into and withdrawn from upper member 102 while reliably gripping the writing instrument during operation. For example, if device 110 were formed of resilient foam, then the resilient nature of the foam would cause a writing instrument of slightly larger diameter than openings 108 to be gripped simply upon its insertion into the openings. In such case, the user may withdraw the writing instrument by pulling it from the opening. However, for users with limited gripping ability, the writing instrument can simply be pushed through the opening in the direction of its insertion by the weight of a user's hand.

If device 110 is formed from more rigid, yet still somewhat flexible material, then the inner walls of the openings may be formed to define flexible teeth or flaps that firmly grip a writing instrument during operation but permit its ready withdrawal in the manners described above.

Additionally, all of embodiments of the writing assistance device described herein relate to members that are pivotally connected to one another. However, the present invention is not so limited. Instead of a pivotal connection, the base and upper members may be movably connected to one another in other ways. By way of example but not limitation, rather than being physically connected by a hinged connection, the base and upper members may be separate, disconnected members. For instance, the base and upper members may be linked by a plurality, such as, for example, three equiangularly arranged spring and screw arrangements similar to the spring 86 and screw 88 arrangement shown in FIG. 12. So constructed, the weight of a user's hand and forearm may easily depress the upper member into contact with the base member to bring a writing instrument into contact with the writing surface.

Although the invention has been described in detail for the purpose of illustration, it is to be understood that such detail is solely for that purpose and that variations can be made therein by those skilled in the art without departing from the spirit and scope of the invention as claimed herein.

What is claimed is:

1. A writing assistance device comprising:

hand support means comprising a base member adapted for contacting a surface upon which a user intends to write and an upper member movably connected to the base member and adapted to be contacted by a user's hand;

at least one writing instrument holder operable to receive a writing instrument; and means for releasably connecting said one writing instrument holder to said hand support means, wherein said means for releasably connecting comprises:

a depressible button;

cooperating means carried by said button and said writing instrument holder for releasably interlocking said writing instrument holder and said button; and means for biasing said button into a position wherein said writing instrument holder is interlocked with said button.

2. The writing assistance device of claim 1 further comprising writing instrument raising means for separating said base and upper members when a user lifts his or her hand from the upper member.

3. The writing assistance device of claim 2 wherein said writing instrument raising means comprise means for biasing said upper member into a separated position with respect to said base member.

4. The writing assistance device of claim 3 wherein said means for biasing comprise at least one spring.

5. The writing assistance device of claim 1 further comprising means for hingedly connecting said base and upper members.

6. The writing assistance device of claim 5 further comprising means for biasing said upper member into a separated position with respect to said base member.

7. The writing assistance device of claim 1 wherein said upper member is generally convex in shape and contoured to substantially mate with the undersurface of the human hand in a relaxed state.

8. The writing assistance device of claim 1 further comprising means carried by a bottom surface of said base member for reducing a writing surface contact area of said base member.

9. The writing assistance device of claim 1 wherein said cooperating means comprise:

a narrow slot portion and a wide slot portion provided in said button;

a notched area and flanged area provided at one end of said writing instrument holder wherein said notched area is narrower than both said narrow and wide slot portions of said button, and wherein said flanged area is wider than said narrow slot portion and narrower than wide slot portion of said button.

10. The writing assistance device of claim 1 wherein at least one writing instrument holder comprises means for enabling a writing instrument to be inserted into and withdrawn from said hand support means in the same direction.

* * * * *